United States Patent [19]

Shannon

[11] 3,973,768

[45] Aug. 10, 1976

[54] DETACHABLE FEED MECHANISM FOR PRINTING DEVICES AND THE LIKE

[76] Inventor: Richard E. Shannon, 355 Albert Drive, Florissant, Mo. 63031

[22] Filed: Nov. 22, 1974

[21] Appl. No.: 526,125

[52] U.S. Cl. ..... 271/99; 271/108; 271/132; 271/166

[51] Int. Cl.[2] ..... B65H 3/12

[58] Field of Search ..... 271/99, 102, 108, 165, 271/166, 131–138, 141–144

[56] References Cited

UNITED STATES PATENTS

| | | | |
|---|---|---|---|
| 2,331,533 | 10/1943 | Bishop | 271/99 |
| 2,743,103 | 4/1956 | Ebner | 271/143 |
| 2,954,976 | 10/1960 | Anderson et al. | 271/144 X |
| 2,995,359 | 8/1961 | Gulick | 271/108 X |
| 3,019,017 | 1/1962 | Brownsey | 271/141 |
| 3,202,420 | 8/1965 | Dovey | 271/99 |
| 3,844,551 | 10/1974 | Morrison | 271/99 |

FOREIGN PATENTS OR APPLICATIONS

| | | | |
|---|---|---|---|
| 473,406 | 10/1937 | United Kingdom | 271/99 |

*Primary Examiner*—John J. Love
*Assistant Examiner*—Bruce H. Stoner, Jr.
*Attorney, Agent, or Firm*—Charles B. Haverstock

[57] ABSTRACT

A feed apparatus for the input of a printing machine or the like having stationary and movable platform portions and upwardly extending adjustable guides, the forward end of the movable platform portion including a cavity portion which communicates with a source of suction pressure for gripping an article to be printed, and a guide member spaced from the cavity to form a space through which the forward edge of an article to be fed moves toward the printing machine. The subject feed unit also includes a drive for reciprocating the movable bed portion, and a timed valve for communicating the cavity to the source of suction pressure and an adjustable rod member to adjust the timing of the suction producing valve.

19 Claims, 11 Drawing Figures

DETACHABLE FEED MECHANISM FOR PRINTING DEVICES AND THE LIKE

There are in existence many different kinds of feed devices for printing and other paper feeding apparatus, and some of the known devices include suction means, reciprocating feedbeds and other devices to separate and feed the articles such as sheets or envelopes from a stack and into the machine for some purpose. There are also in existence such devices which have provisions for stacks of the articles to be fed and some feed from the bottom of the stack. However, so far as known, it has not heretofore been proposed to devise a feed unit such as the present feed unit which can be easily and quickly attached to and removed from a printing or other apparatus for operating in concert therewith and which may derive its power directly from the apparatus to which it is connected. Furthermore, it has not heretofore been proposed to combine stationary and movable platform members with timed suction means which facilitate the feeding of papers and envelopes in stacks even when the stack is relatively small and regardless of the size and shape of the articles being fed. Also providing a reciprocating, as distinguished from a rocking or rotating platform means, with suction means associated therewith is also believed novel in such a feed device.

It is therefore a principal object of the present invention to provide improved feed means for printing and like devices.

Another object is to provide improved means for feeding stacks of envelopes and other similar matter into a machine.

Another object is to provide novel adjustable valve means for controlling and timing the application of vacuum pressure in a paper feed mechanism.

Another object is to provide feed means which can be adjusted to accommodate different sizes and shapes of envelopes and other paper items to be printed.

Another object is to provide a feed magazine for a printing machine which does not need to have a weight placed on the items being fed.

Another object is to provide a feed mechanism for a printing machine which can share the same drive means used for driving the printing machine.

Another object is to provide a feed mechanism which can be installed relatively quickly and easily on a printing machine and which can be removed and replaced by other means when desired.

Another object is to provide an envelope feed mechanism which has stationary and reciprocating feedbed portions.

Another object is to provide a feed mechanism for feeding paper products which can be operated and adjusted including being adjusted to accommodate different size envelopes by persons having relatively little skill and training.

These and other objects and advantages of the present feed mechanism will become apparent after considering the following detailed specification which covers a preferred embodiment thereof in conjunction with the accompanying drawings, wherein.

Figure 1:
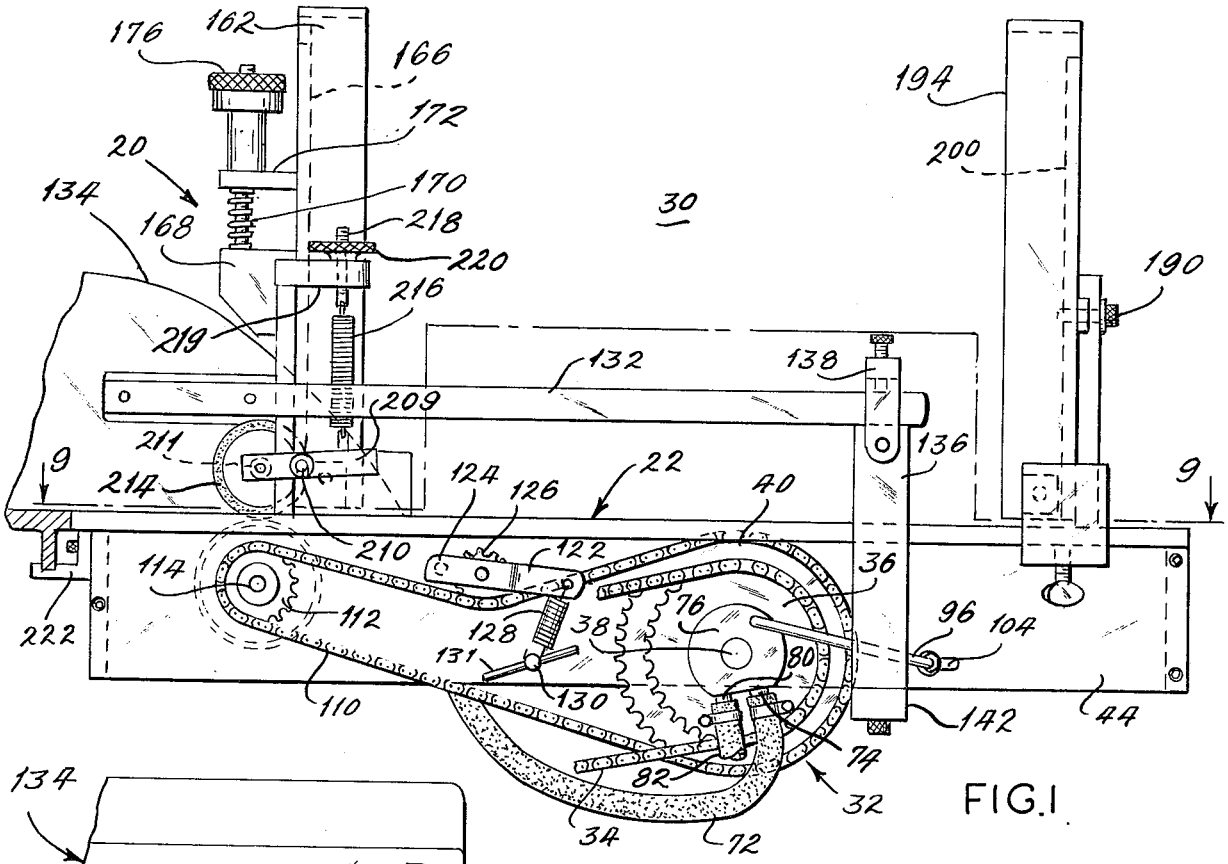
FIG. 1 is a fragmentary side-elevational view showing a portion of the subject feed mechanism.

Referring to the drawings more particularly by reference numbers, number 20 in FIG. 1 refers to a feed mechanism for a multilith or other type printing machine constructed according to the present invention. The feed mechanism 20 has a bed 22 on which articles to be fed such as envelopes are positioned. The bed 22 is formed by two spaced stationary platform members 24 and 26 and a reciprocating bed platform member identified generally by the number 28 (FIGS. 2–6). In the preferred form of the present invention the reciprocating bed platform 28 is positioned between the stationary platforms 24 and 26 and during operation of the machine the reciprocating platform 28 moves back and forth in its plane as will be described. The subject feed mechanism includes a magazine portion 30 in which envelopes 31 or other objects to be fed are positioned, and the device also includes drive means 32 which are shown as chain and sprocket drive means. The drive means are preferably coupled to a power source located in the printing machine to which the subject feed is attached although a separate drive source could be provided if desired. The drive means 32 are coupled to the drive means of the printing machine by chain 34 which chain extends around sprocket 36 on the subject device as shown in FIG. 1. The sprocket 36 is mounted on shaft 38 with another sprocket 40 and with the rotatable portion 42 of valve means which will be described more in detail hereinafter in connection with FIGS. 10 and 11.

Figure 2:
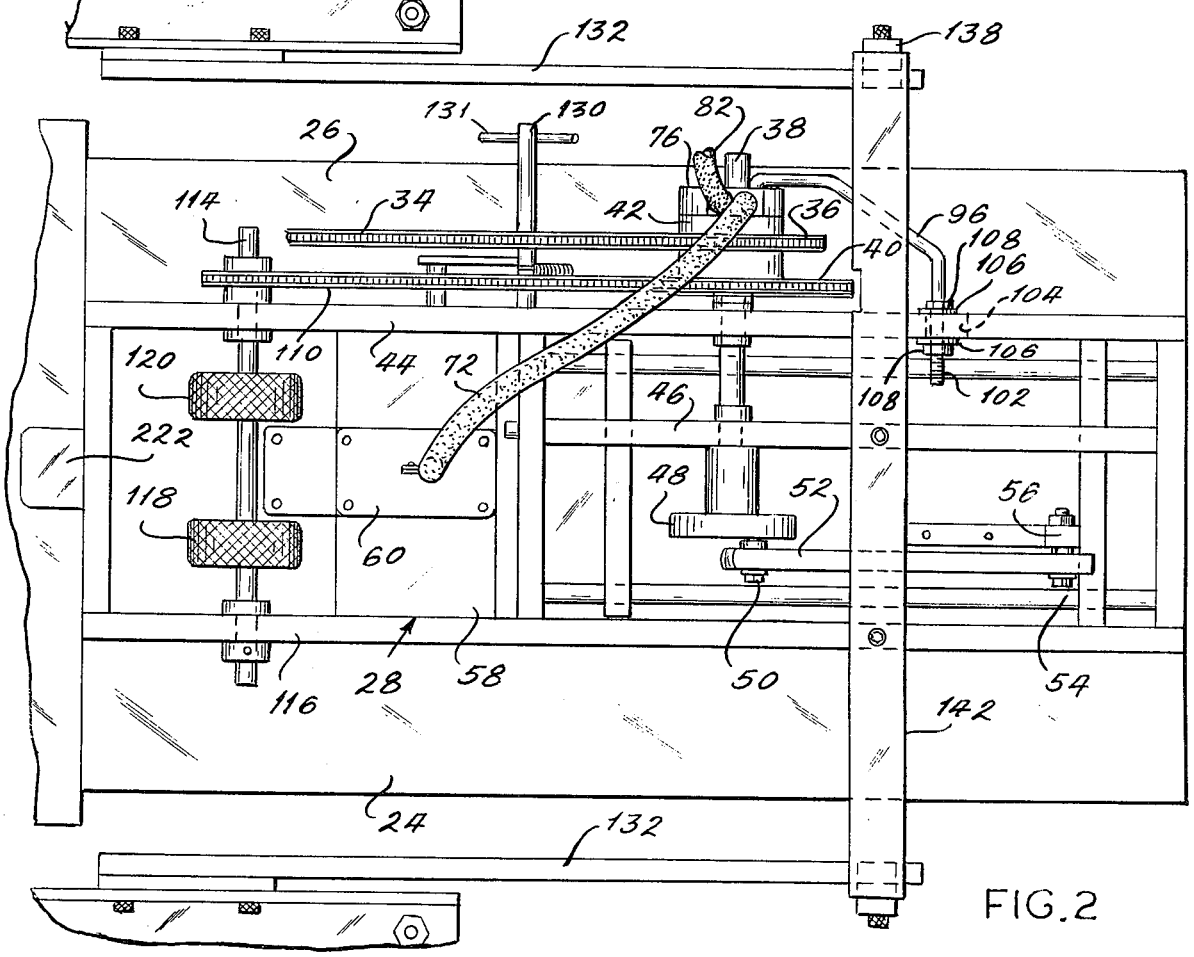
FIG. 2 is a bottom view of the feed mechanism shown in FIG. 1.

The shaft 38 extends through and is journaled to holes provided therefor in stationary wall members 44 and 46 as clearly shown in FIG. 2, and one end of the shaft 38 carries a rotatable member 48 which has an off-center crank pin or stud 50 to which is journaled one end of a crank arm 52. The opposite end of the crank arm 52 is journaled to another stud or pin 54 which is fixedly connected to the reciprocating bed portion 28 of the subject feed mechanism by the member 56. It can therefore be seen that when the shaft 38 and the member 48 are rotated the stud 50 will move the crank arm 52 in such a manner as to move the reciprocating bed portion 28 back and forth. The reciprocating bed 28 is supported on the upper surfaces of the walls 44 and 116 and running clearance is provided to the stationary platform portions 24 and 26. It is important to note that the motion imparted to the reciprocal bed 28 is linear reciiprocating motion, not rocking or tilting motion such a typifies many known feed mechanisms. This is an advantage in the present device because it means that the stationary and movable bed portions 24, 26 and 28 in the present device always have their upper surfaces which form the bed 22 in the same plane, and envelopes or other members to be fed will always be supported on a substantially continuous, flat surface albeit a flat surface formed by adjacent stationary and reciiprocating members. This means that the objects being fed are not continuously jiggled and repositioned during feeding but instead only the bottom object will be gripped and accurately fed into the printing machine under carefully controlled, yet adjustable conditions.

Figure 3:
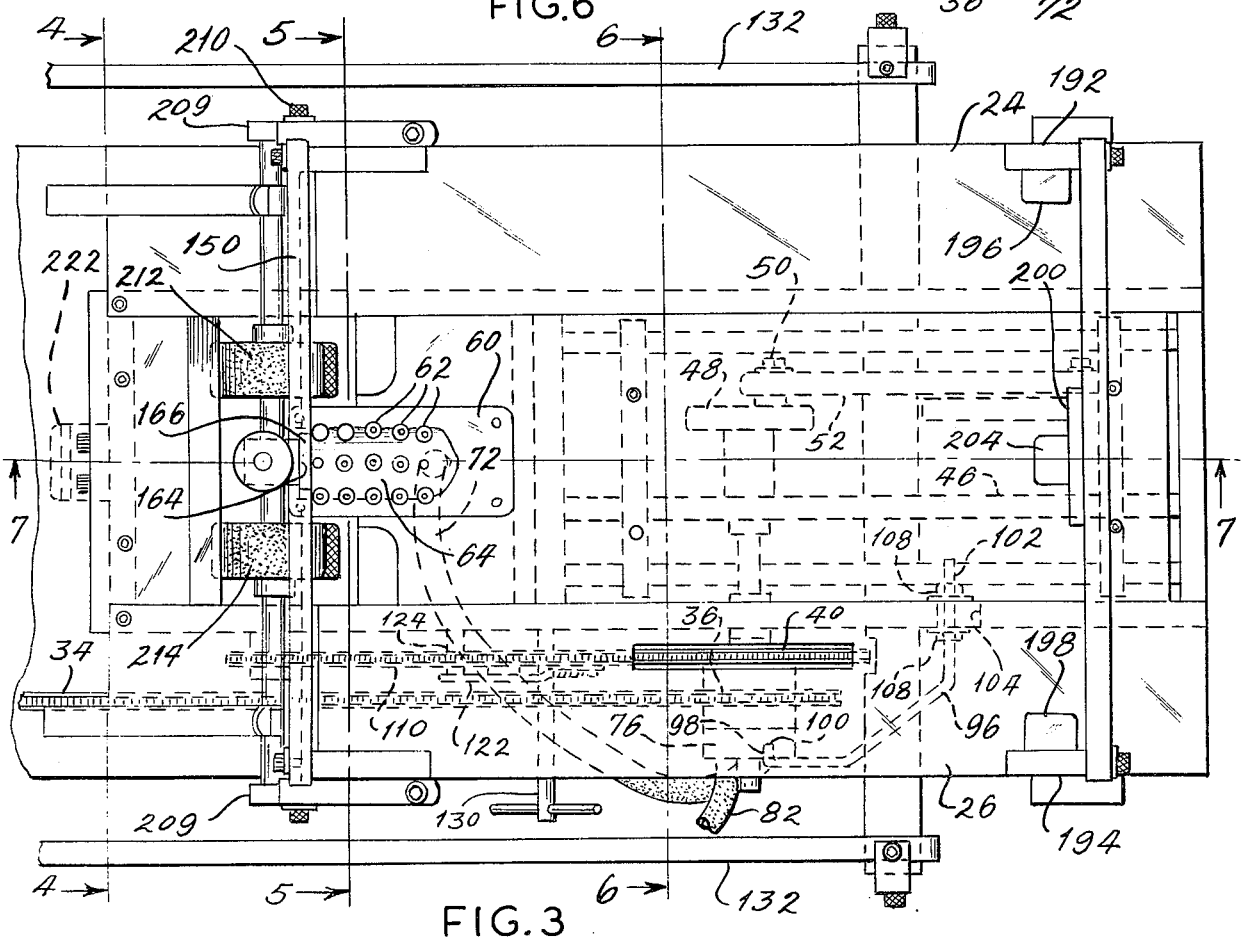
FIG. 3 is a top plan view of the same feed mechanism.
Figure 5:
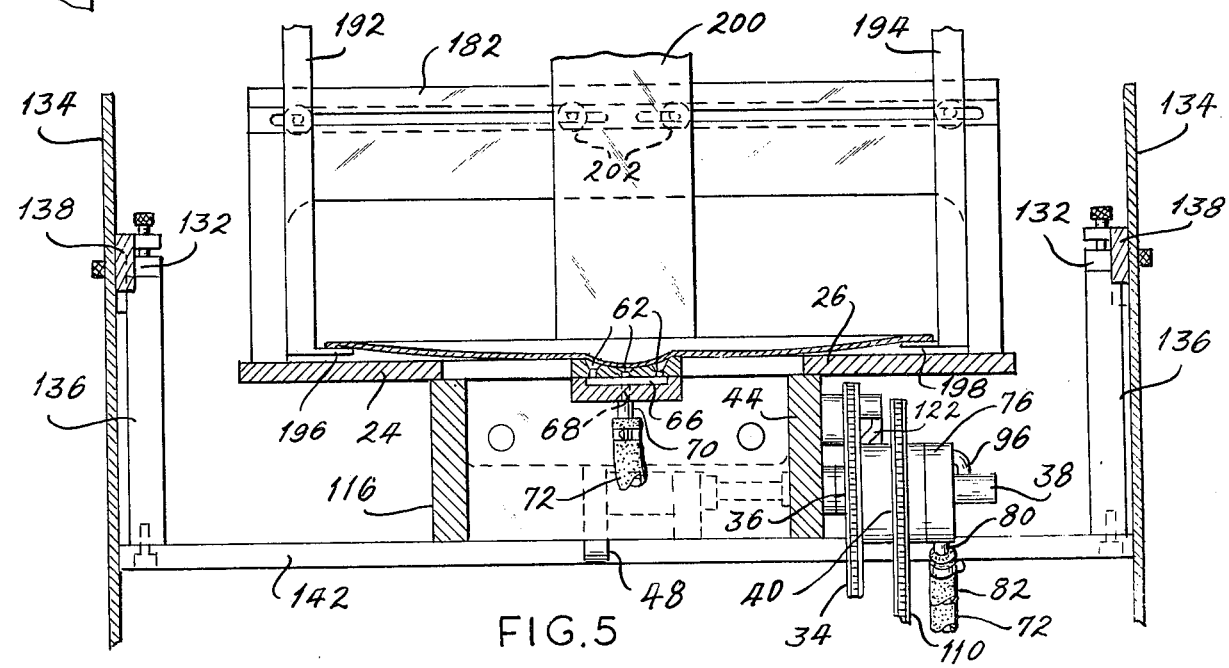
FIG. 5 is a cross-sectional view taken on line 5—5 of FIG. 3.
Figure 7:
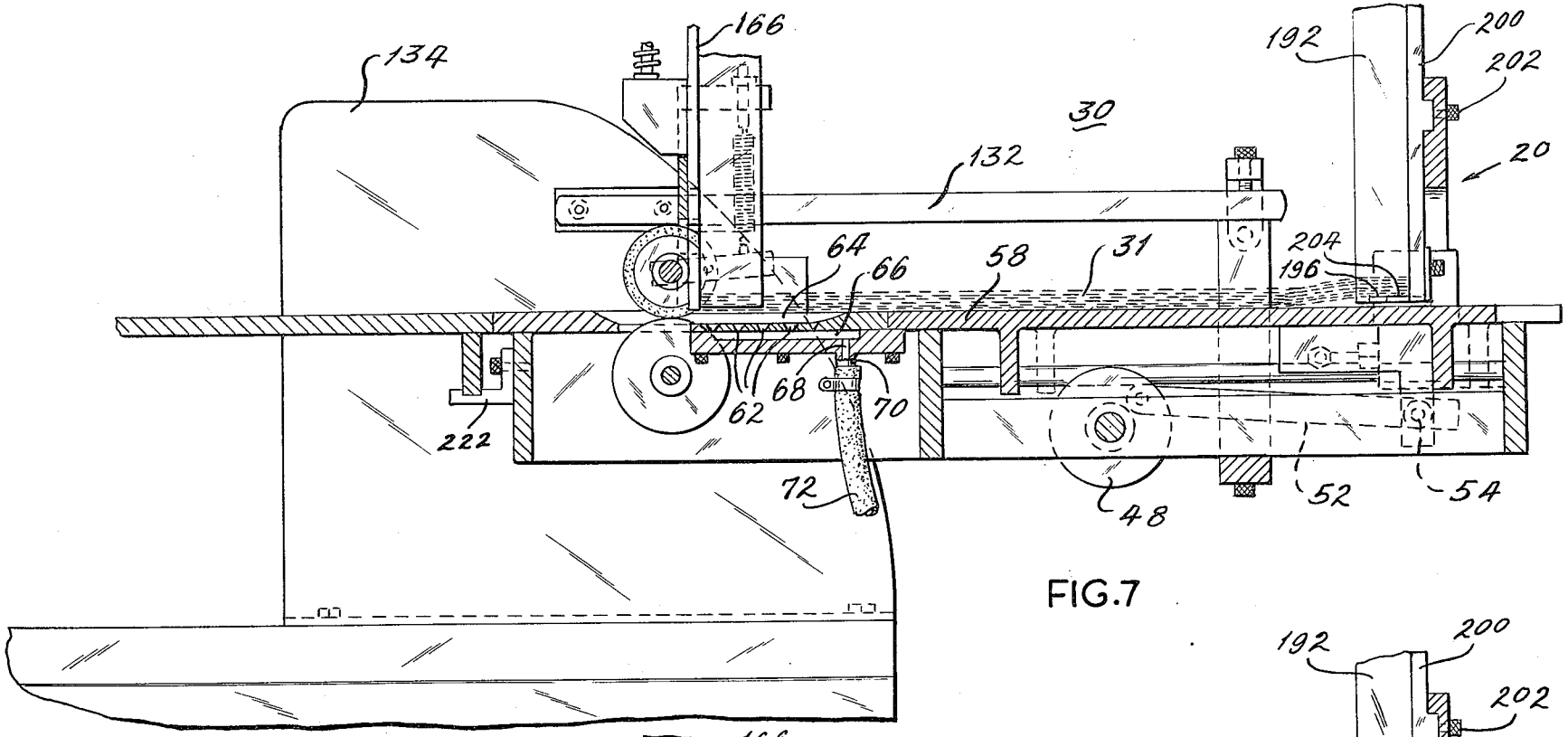
FIG. 7 is a cross-sectional view taken on line 7—7 of FIG. 3.
Figure 8:
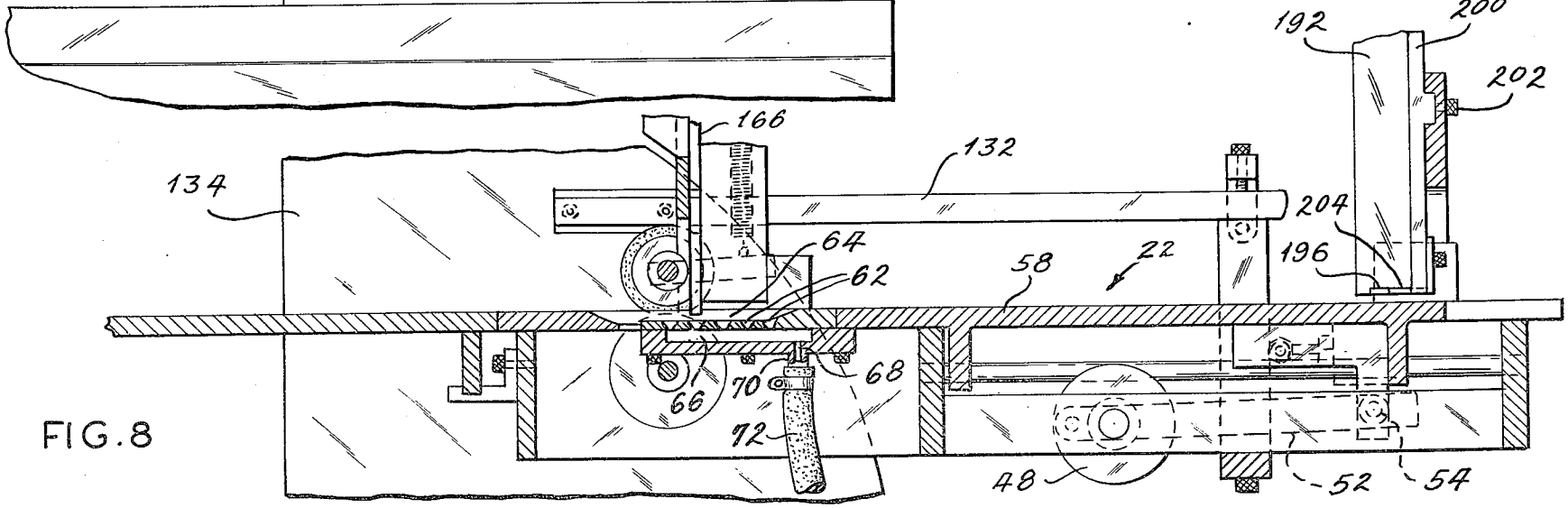
FIG. 8 is a cross-sectional view similar to FIG. 7 but showing the device in a different operating position.
Figure 9:
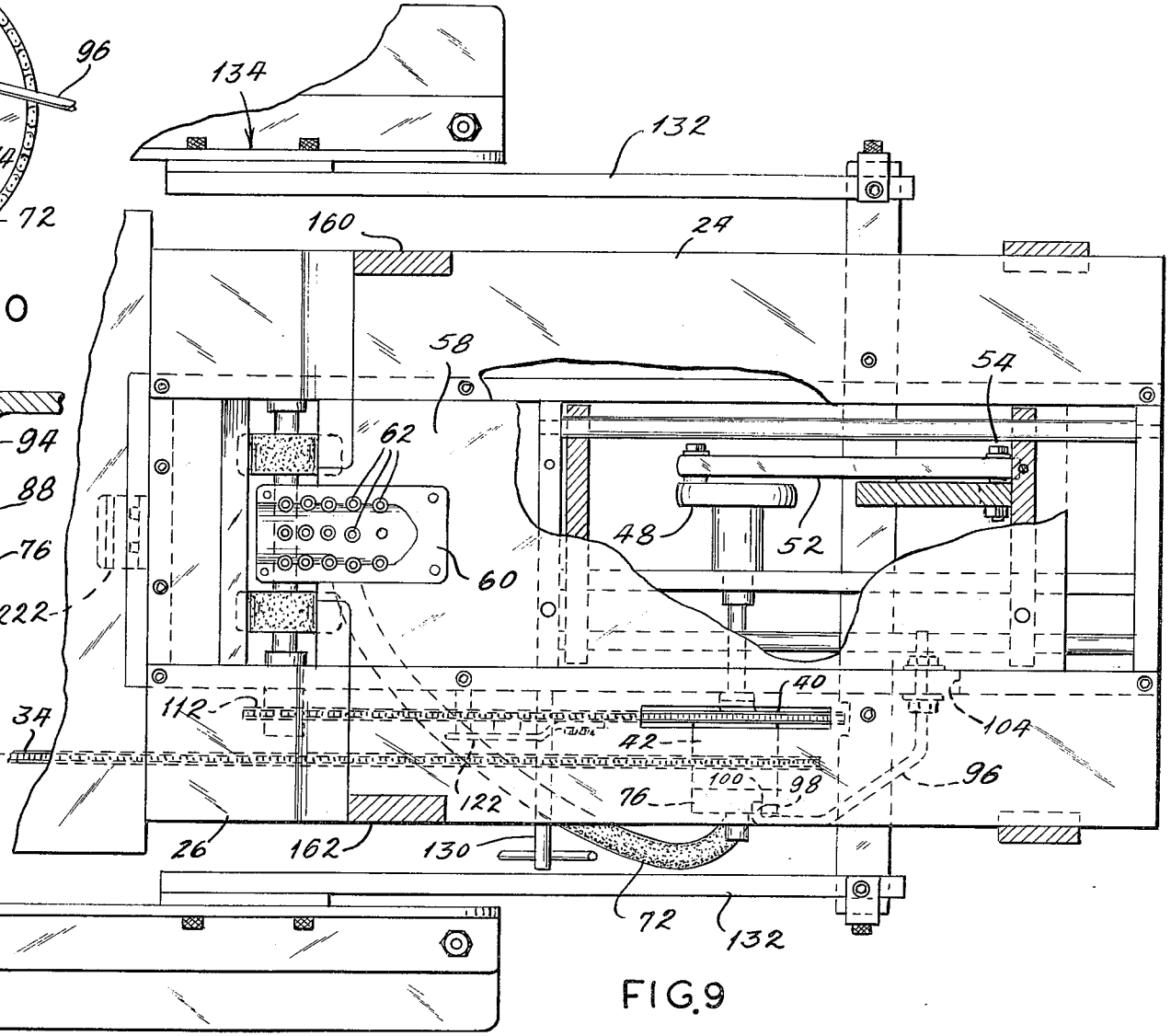
FIG. 9 is a cross-sectional view taken on line 9—9 of FIG. 1; said view being partly broken away to expose some of the mechanisms.
Figure 10:
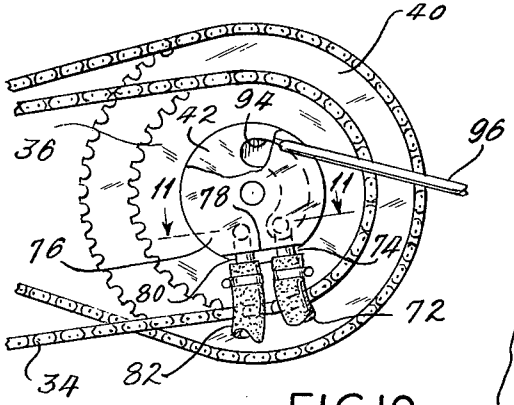
FIG. 10 is an enlarged view showing the sprocket and valve mechanism of the subject device; and, FIG. 11 is an enlarged fragmentary cross-sectional view taken on line 11—11 of FIG. 10.

The reciprocating feedbed portion 28 includes a horizontal wall member 58 which extends between the stationary bed portions 24 and 26 substantially the full length of the bed, and the forward end of the movable bed member or plate 58 carries a centrally located plate 60 which is attached thereto by threaded or other means. The plate 60 is sometimes called the suction plate and has a plurality of upwardly facing orifices 62 which are located in a recess 64 formed in the upper surface thereof (FIGS. 3, 5 and 7). The orifices 62 communicate with a chamber 66 formed in the plate member 60 as clearly shown in FIGS. 5 and 8. A port 68 also communicates with the chamber 66 and is provided with a fitting 70 which receives one end of a flexible tube 72. The opposite end of the tube 72 is fixedly connected by another fitting 74 located on a stationary valve member 76 which is supported on the shaft 38 in position adjacent to the rotatable valve member 42. In FIG. 10 the fitting 74 is shown located on a flat 78 formed on one side of the valve member 76 in spaced relation to a second fitting 80 which receives one end of another tubular conduit 82. The opposite end of the conduit 82 is connected to a source of vacuum pressure such as to a vacuum pump (not shown).

Figure 11:
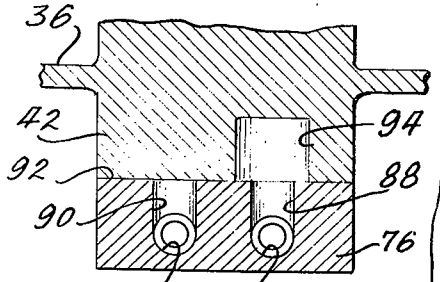

Referring to FIGS. 10 and 11, the fitting 74 is shown communicating with a bore 84 located in the valve member 76, and the fitting 80 is shown communicating with a parallel spaced bore 86 in the same member. The bores 84 and 86 in turn communicate respectively with other spaced bores 88 and 90 which are shown extending therefrom at right angles through the member 76 to the opposite surface 92 thereof which is the surface positioned adjacent to the rotating valve member 42. The rotating valve member 42 has an arcuate shape groove 94 formed therein (FIGS. 10 and 11), and the arcuate groove 94 has a predetermined length and shape which is capable of bridging the space between and providing communication between the bores 88 and 90 in some but not all positions of the valve member 42 relative to the valve member 76. The groove 94 is made long enough so that when the machine is operating and the movable valve member 42 is rotating the elongated groove 94 will provide timed intervals for communication between the bores 88 and 90 and in turn between the suction pumping means and the orifices 62 in the plate member 60.

The timing of the communications established between the bores 88 and 90 by the groove 94 is controlled by means which position the non-rotatable valve member 76 on the shaft 38. This includes an adjustable rod member 96 which has a first formed end portion 98 that extends into a hole 100 (FIG. 3) in the stationary valve member 76. The opposite end of the rod 96 is threaded at 102 and extends through an elongated hole or opening 104 (FIG. 1) in the fixed frame member 44. The threaded end of the rod 96 carries a pair of spaced lock washers 106 and locknuts 108 (FIGS. 2 and 3). If it is desired or necessary to adjust the timing of the valve means this is done by adjusting the position of the stationary valve member 76 and is accomplished by loosening one or both of the locknuts 108, repositioning the rod end 102 in the opening 104 and retightening the locknuts 108. This relocates the positions of the bores 88 and 90 in the stationary valve member 76 so that the times in which they communicate through the groove 94 is changed. This in turn adjusts the timing when suction will be applied to the suction plate 60 and to the envelopes being fed. As already explained, the timing of the application of the suction pressure should be made to occur during part of the machine cycle when the movable bed 28 is moving toward the printing machine so that the lowermost item will be drawn down and fed through the machine throat as will be described.

It has been found that timed valve means of the type disclosed, even when the relatively movable valve members 42 and 76 are not sealed together by any special sealing means, provide a good timed suction action during a feeding operation and this is true because the suction itself draws and holds the members 42 and 76 together during operation. This also means that the stationary valve member 76 can be relatively loosely supported by the shaft 38, a condition that minimizes binding and wear and yet facilitates adjustment of the timing as described. It is contemplated, however, to lubricate between the members 42 and 76, if desired, or to provide other sealing means between them, although this has not been found necessary especially if the adjacent surfaces of the relatively movable valve members are fairly accurately formed and machined.

Referring again to FIG. 1, the larger diameter sprocket 40 on the drive means 32 has another drive chain 110 mounted extending therearound. The opposite end of the chain 110 extends to and around a smaller diameter sprocket 112 mounted on another shaft 114 located below the bed 22 adjacent to the forward end of the feed mechanism. The shaft 114 is journaled to the fixed wall 44 and to another fixed wall 116 located on the opposite side of the reciprocating bed member 58. The shaft 114 carries a pair of spaced drive rollers 118 and 120 which are shown as being metal drive rollers which preferably have their surfaces roughened or serrated as required. During the operation of the subject machine the drive rollers 118 and 120 continuously rotate and in a direction to advance an envelope or other article being fed from the magazine toward the printing or other machine. Means are also provided to maintain tension on the chain 110. This includes an arm 122 which is pivoted to the wall 44 by pivot means 124. The arm 122 carries an idler sprocket 126 which engages the chain 110 at one intermediate position and maintains pressure thereon by the force of a spring 128 which has one end connected adjacent to the free end of the arm 122 and its opposite end anchored to the wall 44 by rod member 130. The member 130 is threadedly locked and loosened to the wall 44 by means of a transverse pin 131. adjacent to The feed unit 20 includes means which are used to connect it to the printing machine. These means include spaced rod members 132 which are fixedly connected to spaced side walls 134 on the printing machine, and the rods 132 extend rearwardly therefrom to cooperate with respective posts 136 located on opposite sides of the feed unit. Each of the posts 136 has an L-shaped member 138 attached thereto adjacent to its upper end, and each of the L-shaped members 138 has a set screw or wing nut 140 which can be tightened to bear against the upper surface of the respective rods 132 to complete rigid connections between the subject feed unit and the printing machine to which it is attached. The vertical posts 136 on opposite sides of the machine are connected to their lower ends to a cross member 142 which is shown located extending across the bottom of the feed unit.

Figure 4:
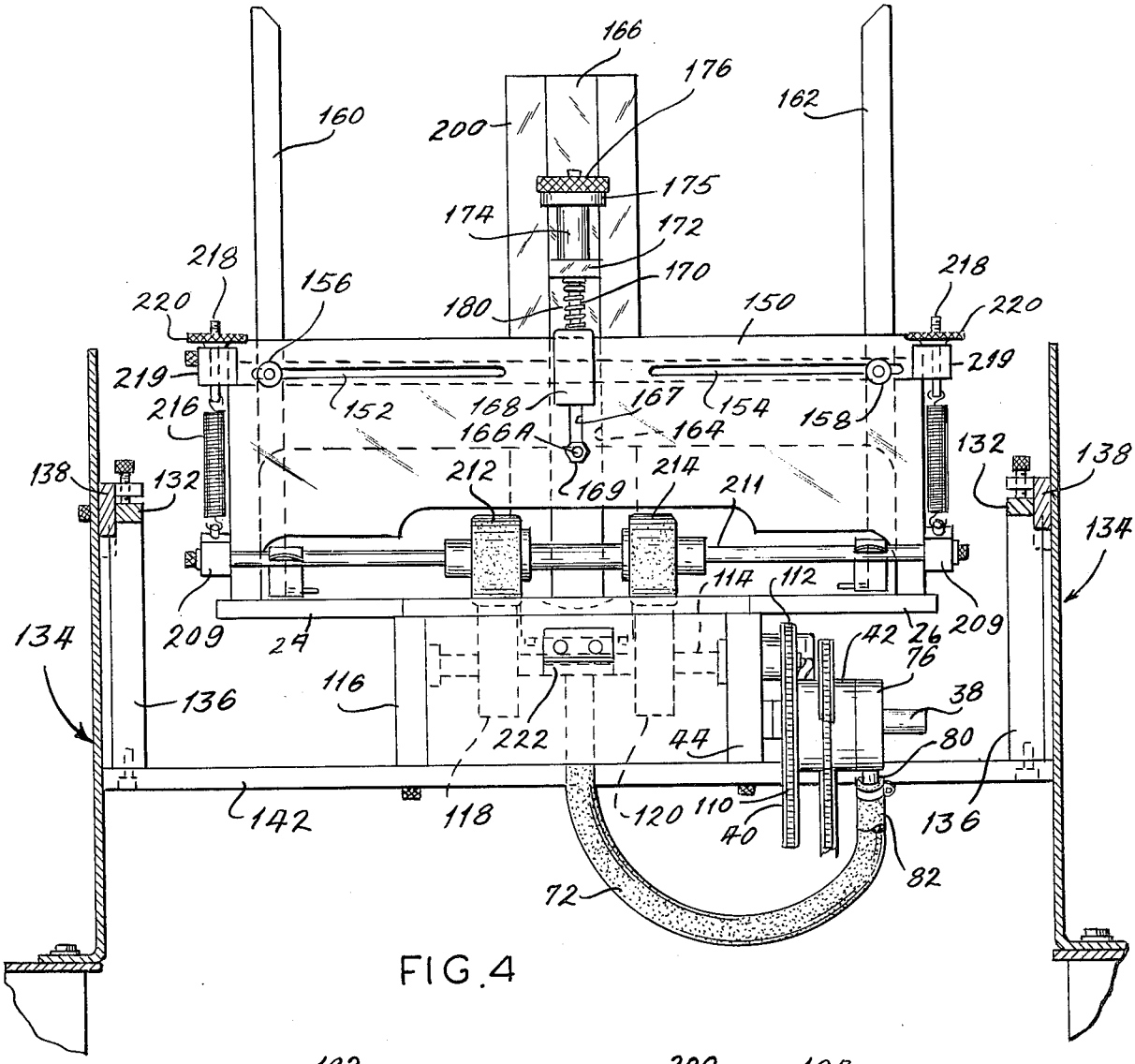
FIG. 4 is a cross-sectional view taken on line 4—4 of FIG. 3.

The forward end of the feed magazine has a vertical wall member 150 which is spaced above the bed 22 and is attached to the stationary bed structure as shown in FIG. 4 and as will be described. The wall 150 has a pair of aligned horizontal slots 152 and 154 which extend substantially the length thereof, and the slots 152 and 154 respectively receive threaded locking members 156 and 158 which are used in the adjustment of the size of the magazine. The threaded members 156 and 158 extend through the respective slots and into threaded bores in associated vertical magazine side posts 160 and 162. When the threaded members 156 and 158 are loosened the side posts can be moved to reposition them as desired depending upon the width of the envelopes or other articles to be fed. When properly positioned, the locking screws 156 and 158 are retightened to retain the adjustment. At the center of the forward wall 150 and on the rear side thereof is located a vertical slot 164 (FIGS. 3 and 4) which receives a forward vertical guide member 166. The guide member 166 forms part of the forward wall of the bed and extends downwardly to adjacent the forward end of the reciprocating bed 58. More particularly the lower end of the guide member 166 extends to a position above the plate 60 wherein the vacuum suction inlets 62 are located. The forward wall member 150 also has fixedly attached to it a block member 168. A rod 170 with a threaded upper end portion extends into abutment with the fixed block 168 and also extends upwardly through a bore in another block 172 attached to the guide member 166. From there the rod 170 extends through a sleeve member 174 which is shown in FIG. 4 having a flange 175 on its upper end, and the threaded upper end of the rod 170 is threaded engaged with a knurled adjustment member 176. The guide member 166 also receives a locking screw 166A which has a flat head surface on the end which faces into the magazine. The screw 166A also extends forwardly through a vertical slot 167 at the center of the wall 150 and a lock nut 169 is on its opposite end. The nut 169 must be loosened to permit vertical movement of the member 166 during adjustment and when the adjustment is made the lock nut 169 is retightened to hold the adjustment. When making an adjustment of the position of the member 166 the knurled member 176 is rotated in one direction to relocate the member 166 at a lower position by moving downwardly on the block 172 and on the guide member 166. This narrows the throat formed between the members 166 and 60. A compression spring 180 is positioned around the rod 170 in the space between the fixed block member 168 and the movable block 172 to maintain the position of the member 166 until it is locked. In this way, the position of the vertical guide member 166 is adjusted to adjust the size of the throat opening.

Figure 6:
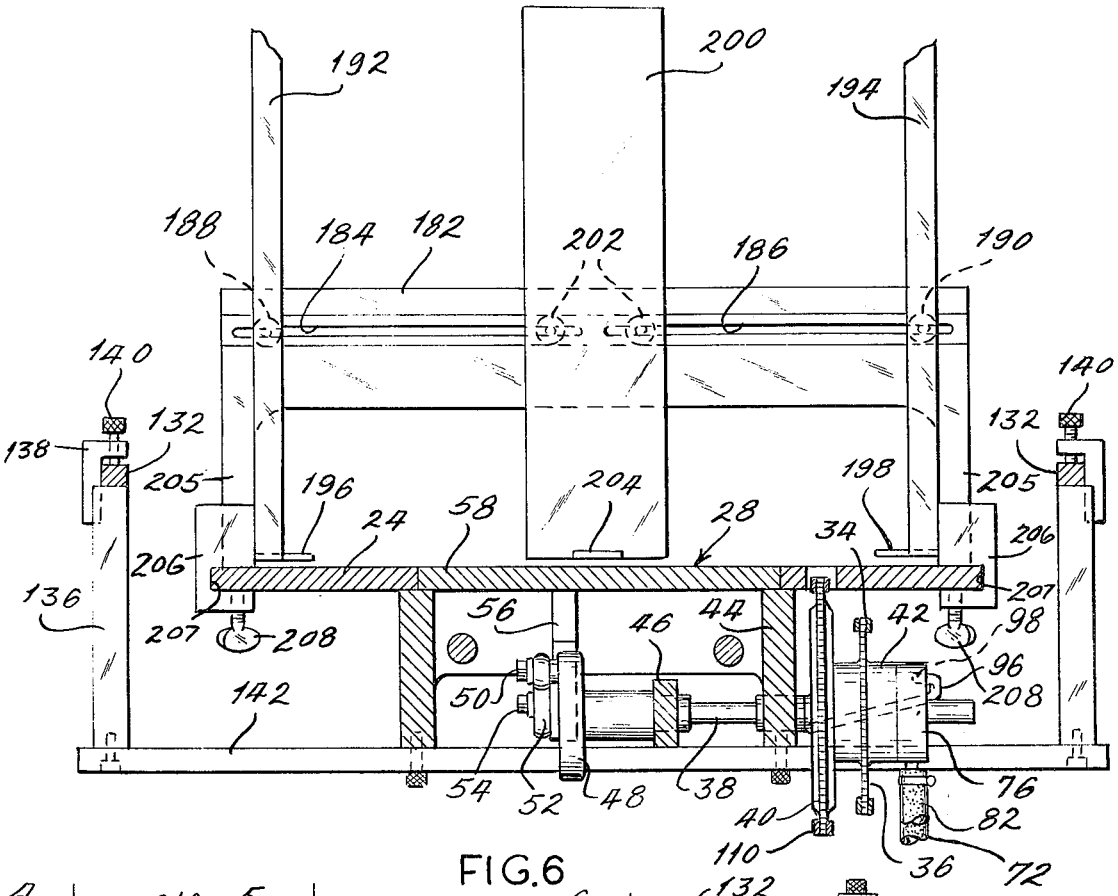
FIG. 6 is a cross-sectional view taken on line 6—6 of FIG. 3.

A second vertical wall member 182 extends across the rear end of the magazine, and like the wall 150, it has a pair of aligned horizontal slots 184 and 186 formed therein (FIGS. 5 and 6). The slots 184 and 186 respectively received threaded fasteners 188 and 190 which in turn cooperate with threaded holes in vertical magazine rear side posts 192 and 194. The posts 192 and 194 form the rear sides of the magazine and each is provided with a sidewardly extending projection or tab 196 and 198 attached near to the lower end thereof. The tabs 196 and 198 extend partway out into the magazine and support the rear side edges of a stack of articles to be fed at a slightly elevated position. This is done to facilitate looseness between the stack of articles and the magazine side walls and to make it easier for each succeeding lowest article to be separated from the stack and to move forwardly during a feeding operation. A center rear guide plate 200 is also attached to the rear wall 182 by other threaded members 202, and the lower end of the guide plate 200 has a forwardly extending projection or tab 204 which serves the same general purposes as the side tabs 196 and 198.

Referring again to FIG. 6, the rear wall member 182 is shown having depending leg portions 205 which extend downwardly from opposite ends thereof and each of the leg portions 205 is connected at its lower end to a block 206 which has a sidewardly extending groove 207 formed therein. The grooves 207 on the two spaced blocks 206 are in opposing relation to cooperatively receive side edge portions of the respective stationary bed members 24 and 26. Also, each block 206 receives a threaded locking member shown as wing nuts 208, and the members 208 can be loosened to permit adjustment by sliding of the position of the rear magazine wall structure which includes the members 182, 192, 194, 200, 205 and 206 along the bed 22. When the rear magazine wall structure is positioned as desired the members 208 are tightened to retain the adjustment. This adjustment is easily made while one or more articles to be fed are in the magazine. When the threaded members 208 are loosened the entire rear wall structure can also be removed from the feed unit for maintenance or other reasons, as desired.

Referring again to FIG. 1 there is shown pivotally attached to each opposite side of the feedbed adjacent to the forward end thereof, feed roll tensin means in the form of a biased pivoted member 209. The members 209 are pivotally attached to the respective opposite sides of the wall member 150 by studs 210 and the forward ends of the pivot members 209 are connected to respective ends of a feed roll shaft 211 which extends across the bed on the forward side of the forward magazine wall 150. Journaled to the shaft 211 are two spaced, preferably rubber or rubberized, feed rolls 212 and 214 which are aligned respectively with and engage the lower metal feed rolls 118 and 120. The rearwardly extending ends of the pivoted members 209 are connected to adjustable feed roll tension springs 216 which extend upwardly therefrom and have their upper ends connected to threadedly adjustable means shown as threaded member 218. The members 218 extend through openings in fixed blocks 219 and have threaded nuts 220 which are adjusted to adjust the spring tension. The tension on the springs 216 is adjusted to apply desired downward pressure on the feed rolls 212 and 214 against the feed rolls 118 and 120.

The forward end of the feed unit 20 as shown in FIGS. 1 and 3 is also provided with a forwardly extending L-shaped positioning bracket 222 which is accurately located thereon and formed to cooperate with positioning means located on the printing machine to which the subject feed is attached. The bracket 222 helps to properly locate the fed unit during installation. In order to attach the feed unit 20 to a printing machine, the unit is lifted into position with the tongue or L-shaped member 222 properly located with respect to the cooperating means on the printer and with the rearwardly extending rods 132 which are connected to opposite walls 134 of the printer in positions extending adjacent to the top of the posts 136 and under the overhanging portion of the members 138. The screws 140 are then tightened against the rods 132 preferably using a wrench such as an Allen wrench to hold the feed unit in place. It may also be necessary to connect one of the ends of the tube 82 (FIG. 10) to the outlet of a suction pumping device to complete the installation. After the installation is completed some adjustment to the timing of the valve means may be necessary to provide the best possible operating condition. This is accomplished as aforesaid by adjusting the position of the adjustment rod 96 in the elongated hole 104 provided therefor in the frame member 44. This adjustment is fairly easily and accurately made even on a trial and error basis, and when completed the machine is in condition for operation.

When the printing machine is operating it will provide the power necessary to also operate the subject feed unit through the connection provided by the chain 34. The power provided will cause the reciprocating bed portion 28 to move back and forth under control of the crank assembly including the members 48, 50 and 52 and the connection thereof to the pin 54 on the movable frame. At the same time, the chain 110 will drive the lower feed rolls 118 and 120 in a proper direction to advance each item as it is fed from the feed unit through the throat and between the lower rolls 118 and 120 and the mating upper rolls 212 and 214. The same input power will also rotate the movable valve member 42 relative to the stationary valve member 76 to produce the timed suction action through the orifices 62 in the plate 60. During rearward movements of the movable bed 28 the bed simply slides under the lowermost envelope or other article until it reaches its rearmost position and starts to move forwardly. At some point during forward movement of the movable bed 28 communication will be established between the suction pumping means and the suction orifices 62 and when this occurs suction pressure will be applied to the forward, central portion of the lowest-most item or envelope in the stack and this will cause said portion of the lowest item to be pulled downwardly so that it can move under the lower edge of the forward guide member 166 in the space between the guide member 166 and the cavity formed in the plate 60. In so doing, the lowest envelope will be advanced to a position where it moves between the upper and lower feed rolls and is drawn thereby and fed into the printing machine.

It is important to note that the stationary valve member 76 is positioned and supported on the rotating drive shaft 38 such that during operation when the shaft 38 rotates it will encounter minimum resistance from the stationary valve member 76. This is an advantage because it minimizes the need for lubrication and it also minimizes the wear on the parts. Furthermore, the suction pressure introduced into the bores 88 and 90 and into the groove 94 in the members 76 and 42 causes these members to be drawn together into a sealed relationship which if the parts are properly made resists leakage and enables the suction pressure to establish and maintain its own sealed condition. By the same token, when the machine is not operating the stationary valve member 76 can be relatively easily moved for adjustment and other purposes. The shape and position of the valve adjustment rod 96 including the way in which it engages the stationary valve member 76 also helps to keep the valve member 76 from coming off of the shaft 38.

The subject feed unit can be used to feed many different kinds of items including envelopes, cardboard items, paper items including stationary and advertising pieces and the like, and as explained it can be easily and accurately adjusted to accommodate different lengths and widths of articles. Furthermore, it can be made to be installed on many different kinds of printing devices including well known printing machines such as multilith machines and the like.

Thus there has been shown and described a novel versatile feed unit for use with printing and like devices which fullfills all of the objects and advantages sought therefor. It is apparent, however, that many changes, modifications, variations and other uses and applications for the subject feed unit are possible and will become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

What is claimed is:

1. A feed apparatus for printing and like machines comprising a feed magazine for receiving a stack of articles to be fed, said magazine including a platform having a substantially continuous top surface for supporting the articles, said platform being formed by adjacent stationary and movable portions in the same plane and having a forward end, drive means operatively connected to the movable platform portion at a location thereon spaced rearwardly from the forward end, said drive means including means to reciprocate said movable platform portion in the plane thereof, spaced means extending upwardly from positions adjacent to the platform to maintain articles to be fed in a stacked condition thereon, means forming a throat centrally located adjacent to the forward end of the platform through which the lowermost article in the stack can be fed, said throat extending at least in part below the article supporting platform, means centrally located adjacent to the forward end of the movable portion of the platform forming a cavity in the surface thereof adjacent to the throat forming means, a source of subatmospheric pressure and means periodically communicating said cavity with said source including conduit and valve means, said valve means having a pair of relatively movable valve members with cooperating valve chambers formed therein, one of said pair of valve members having an operative connection to the drive means for movement thereby whereby the cooperating valve chambers periodically establish communication between the subatmospheric pressure source and the cavity in the movable platform portion.

2. The feed apparatus of claim 1 wherein said pair of valve members includes a stationary valve member having a first port and means communicating said first port with the cavity in the movable platform portion, a second port and means communicating said second port to the subatmospheric pressure source, and a movable valve member positioned adjacent to the stationary valve member, said movable valve member having passage means capable in some positions thereof of establishing communication between the first and second ports of the stationary valve member, said drive means including means for rotating and supporting said movable valve member adjacent to the stationary valve member, the subatmospheric pressure source operating to maintain said stationary and movable valve members in operating relationship during operation of the feed unit.

3. The feed apparatus of claim 1 wherein the throat is formed by and between a centrally located vertically oriented guide member having a lower end edge and the cavity in the movable platform portion.

4. The feed apparatus defined in claim 3 including spring biased means to adjust the vertical position of the vertically oriented guide member to adjust the size of the throat.

5. The apparatus of claim 1 including a pair of feed rolls positioned adjacent to the throat, one of said feed rolls being operatively connected for movement by the drive means, and means biasing the other roll of said pair of feed rolls toward the driven feed roll.

6. The feed apparatus defined in claim 1 wherein the drive means on the feed apparatus include means for operatively coupling to drive means on the printing or like machine.

7. The feed apparatus defined in claim 1 including means to detachably install the subject feed apparatus on a printing machine.

8. The feed apparatus defined in claim 1 including means for adjusting the positions of the upwardly extending means relative to the platform to accommodate articles to be fed of different dimensions.

9. The feed apparatus defined in claim 8 wherein said means for adjusting the upwardly extending means include spaced vertical guide members located adjacent opposite sides of the platform, and means for adjusting the spacing between said guide members.

10. The feed apparatus defined in claim 9 wherein said means for adjusting the positions of the upwardly extending means include fixed and adjustable end walls positioned adjacent opposite ends of the platform, said adjustable end wall being adjustable relative to the fixed end wall to change the distance therebetween.

11. The feed apparatus defined in claim 1 wherein said means to reciprocate the movable platform portion includes a crank arm having an eccentric pin and a crank lever operatively connecting said eccentric pin to the movable platform portion.

12. A feed apparatus for attaching to printing and like machines that contain drive means comprising a bed on which articles to be fed are positioned, said bed having a forward end and including adjacent stationary and movable portions together defining a substantially continuous upwardly facing article supporting surface thereon, drive means operatively connected to the movable bed portion at a position spaced rearwardly from said forward bed end including means to reciprocate said movable portion relative to the stationary portion while maintaining the article supporting surfaces of said stationary and movable portions in the same plane, means to attach the feed apparatus to a printing machine including means for operatively coupling the drive means to the drive means on the printing machine, means extending upwardly from the bed to define a magazine for containing a supply of the articles to be fed in a stacked condition thereon, means centrally located adjacent to the forward end of the bed forming a throat through which each succeeding lowermost article in a stack of articles on the bed passes during feeding, means associated with the movable bed portion for establishing a suction pressure condition adjacent to the throat including a source of suction pressure and means periodically communicating said source with said movable bed portion adjacent to the throat, said last named means including a suction source, conduit means and valve means including a pair of relatively movable valve members, one of said valve members having a valve inlet port and a valve outlet port, said conduit means communicating one of said ports to the movable bed portion adjacent to the throat and the other of said ports to the source of suction pressure, and means for adjusting the position of one of said relatively movable valve members relative to the other for controlling the timing of the communication between the inlet and outlet valve ports and the timing of the communication between the suction pressure source and the movable bed portion.

13. The feed apparatus of claim 12 including a pair of feed rolls positioned adjacent to the bed and on the opposite side of the throat from the magazine in position to receive articles fed from the magazine through the throat, one of said feed rolls being operatively connected for movement by the drive means.

14. The feed apparatus of claim 12 including means for adjusting the dimensions of the magazine in at least two directions so that the magazine can accommodate articles of different lengths and widths.

15. The feed apparatus of claim 12 including means to elevate selected edge portions of articles to be fed.

16. The feed apparatus of claim 12 wherein said valve means include relatively movable valve members, one of which is operatively connected for movement by the drive means, and the other is maintained stationary adjacent to the movable valve members, said valve members having adjacent surfaces and passage means formed therein which communicate in predetermined relative positions thereof to establish communication between the suction pressure source and the movable platform portions.

17. The feed apparatus of claim 16 including means to change the position of the stationary valve member to change the timing of the application of suction pressure from the suction pressure source to the movable platform portion.

18. The feed apparatus of claim 12 wherein the movable bed portion has a recess formed therein adjacent to the throat, at least one orifice formed in said recess, and means communicating said orifice with the valve means.

19. The feed apparatus defined in claim 12 wherein the drive means includes reciprocating crank arm and means operatively connecting said reciprocating crank arm to the movable platform portion.

* * * * *